US010130953B1

(12) United States Patent
Ranne

(10) Patent No.: US 10,130,953 B1
(45) Date of Patent: Nov. 20, 2018

(54) SUBMICRON PARTICLE GRINDING MILL

(71) Applicant: Bill H. Ranne, Jackson, TN (US)

(72) Inventor: Bill H. Ranne, Jackson, TN (US)

( * ) Notice: Subject to any disclaimer, the term of this patent is extended or adjusted under 35 U.S.C. 154(b) by 0 days.

(21) Appl. No.: 15/653,575

(22) Filed: Jul. 19, 2017

Related U.S. Application Data

(63) Continuation-in-part of application No. 14/886,371, filed on Oct. 19, 2015, now Pat. No. 9,718,064.

(51) Int. Cl.

| | |
|---|---|
| ***B02C 7/00*** | (2006.01) |
| ***B02C 18/16*** | (2006.01) |
| ***B02C 7/12*** | (2006.01) |
| ***B02C 7/16*** | (2006.01) |
| ***B02C 23/02*** | (2006.01) |
| ***B02C 18/14*** | (2006.01) |

(52) U.S. Cl.
CPC ..... *B02C 18/16* (2013.01); *B02C 7/12* (2013.01); *B02C 7/16* (2013.01); *B02C 18/14* (2013.01); *B02C 23/02* (2013.01); *B02C 2018/162* (2013.01)

(58) Field of Classification Search
CPC ... B02C 18/14; B02C 18/16; B02C 2018/162; B02C 7/005; B02C 7/12
USPC ..... 241/236
See application file for complete search history.

(56) References Cited

U.S. PATENT DOCUMENTS 345,408 A * 7/1886 Birge ..... B02C 2/10 241/138
359,630 A * 3/1887 Pratt ..... B02C 13/20 241/187
1,723,055 A 8/1929 Mechlin
2,188,230 A * 1/1940 Nicholson ..... B02C 13/09 241/138
2,466,828 A * 4/1949 Samson ..... B02C 13/00 241/154
2,774,543 A * 12/1956 Keller ..... B02C 13/26 241/138
2,903,192 A * 9/1959 Clausen ..... B02C 18/0092 241/155
2,903,193 A 9/1959 Anderson
(Continued)

FOREIGN PATENT DOCUMENTS

| | | |
|---|---|---|
| DE | 4210207 C1 | 9/1993 |
| GB | 0220144 A | 8/1924 |
| WO | 2010106225 A1 | 9/2010 |

*Primary Examiner* — Faye Francis
(74) *Attorney, Agent, or Firm* — Luedeka Neely Group, PC

(57) ABSTRACT

A mill for grinding particles to submicron size. The mill has a rectangular prism-shaped housing for two internal barrels. Each internal barrel has a shaft and a plurality of overlapping circular discs attached to the shaft for grinding materials to submicron size. Each barrel also has blocked corners providing a cross-sectional shape of half of an octagonal prism disposed toward opposing ends of the housing. The housing also includes comprises curved acceleration ramps disposed between the barrels proximal to the overlapping circular discs on opposing sides of the housing. An inlet is provided for feeding material to be ground by the mill to an overlapped portion of the overlapping circular discs. An outlet is disposed at an end of the mill opposite the inlet for removing ground material from the mill. The overlapping circular discs are rotated in the mill at a shaft speed ranging from about 200 to about 1200 RPM.

19 Claims, 14 Drawing Sheets

(56) References Cited

U.S. PATENT DOCUMENTS

| | | | | | |
|---|---|---|---|---|---|
| 3,610,544 | A | * | 10/1971 | O'Connor | B02C 13/06 241/154 |
| 3,696,817 | A | * | 10/1972 | Bonner, Jr. | A24B 5/10 131/311 |
| 3,891,152 | A | | 6/1975 | Guggenheimer | |
| 4,166,583 | A | * | 9/1979 | Ruckstuhl | B02C 13/20 241/154 |
| 4,235,383 | A | | 11/1980 | Clark | |
| 5,400,977 | A | * | 3/1995 | Hayles, Jr. | B02C 13/20 241/154 |
| 5,511,729 | A | | 4/1996 | Husain | |
| 5,544,820 | A | * | 8/1996 | Walters | B02C 13/04 241/154 |
| 5,826,807 | A | | 10/1998 | Csendes | |
| 5,829,692 | A | * | 11/1998 | Walters | B02C 13/04 241/154 |
| 5,887,809 | A | * | 3/1999 | Walters | B02C 13/04 241/187 |
| 6,422,496 | B1 | | 7/2002 | Doelle | |
| 7,055,769 | B2 | * | 6/2006 | Pierce | B02C 13/20 241/187 |
| 2013/0233953 | A1 | | 9/2013 | Enderle | |
| 2014/0110512 | A1 | | 4/2014 | Lee | |

* cited by examiner

SUBMICRON PARTICLE GRINDING MILL

RELATED APPLICATION

This application is a continuation-in-part of application Ser. No. 14/886,371, filed Oct. 19, 2015, now U.S. Pat. No. 9,718,064.

TECHNICAL FIELD

The disclosure is directed to grinding mills and, in particular, to grinding mills for grinding particles to submicron size.

BACKGROUND AND SUMMARY

There are a wide variety of mills and milling processes that use a variety of techniques to reduce the size of particles. Media mills, such as ball mills and sand mills are particularly useful for obtaining impact between the media and the particle to be reduced in size. However, the media in media mills typically reduce the throughput of material and make it difficult to separate the crushed or ground material from the media. This is particularly true with respect to malleable materials such as sawdust, switchgrass, and other cellulosic materials. Also, it is difficult to obtain particles in the submicron range with media mills of the current design.

While ball mills are suitable for dispersing particles and grinding almost anything, they were extremely noisy. Sand mills are quieter than ball mills and can disperse almost anything, but grind very few materials suitably. For example, pigments used in paints may not be ground sufficiently in sand mills. Comparatively speaking, ball mills provide 65 to 75% impact grinding while sand mills provide only 2 to 4% impact grinding with very little opposing vector grinding. "Opposing vector" means energy source or sources that are directly opposed to one another or opposed with slight angular opposition. Accordingly, paint manufacturers have found it was necessary to pre-grind pigments in jet mills. However, the natural earth oxide pigments, used mainly in paint primers cannot stand the cost of jet mill or air grinding. For illustration purposes, a comparison of milling time between a micro-ball mill and a sand mill with 4 mm shot media and 1 mm shot media is shown in FIGS. 1A and 1B where shear gives way to stress at about 7 to 10 microns.

From FIGS. 1A and 1B, it is evident that the micro-ball mills show 85% to 90% particle size reduction in 1-2 minutes for soft to very hard materials. The sand mill provided very little grinding for hard to medium hard materials. Thus, jet milling is used for medium hard to hard materials. Grinding is slow in sand mills and relatively fast in micro opposing vector ball mills.

The next advance in grinding was an impact media mill that gave 90% particle reduction in the first 10% of normal grinding time. The impact media mill uses opposing energy vectors set to different degrees of interruption and disruption within the confines two media mill barrels. The barrels are designed to prevent vortex formation during grinding. The sidewalls of the barrels are used for transportation, not for spinning force contact between the particles. The chamber and discs are designed to give two thirds head-on impact and one third of angular contact rotation providing about 20% Hochberg grinding. The design of the impact media mill enabled a significant reduction in barrel wear during grinding. However, like other mills, the impact media mill is not efficient or effective for reducing particles to submicron size, i.e., less than 1 micron.

Materials such as fiberglass and fly ash act as fillers in the micron range, but may actually react in the submicron range, similar to pozzolanic materials. A "pozzolan" is defined as a siliceous or siliceous and aluminous material, which possesses little or no cementing property, but will in a finely divided form—and in the presence of moisture—chemically react with calcium hydroxide at ordinary temperatures to form compounds possessing cementitious properties. Pozzolans typically have a particle size of less than 10 microns, such as in the −10 to −20 micron range. Fly ash is the most commonly known artificial pozzolan and results from the burning of pulverized coal in electric power plants. The amorphous glassy spherical particles are the active pozzolanic portion of fly ash. Class F fly ash readily reacts with lime (produced when Portland cement hydrates) and alkalis to form cementitious compounds. In addition to that, Class C fly ash may also exhibit hydraulic (self-cementing) properties. Other pozzolanic materials may be obtained from rice hulls, silica fume, other aluminosilicate/silicoaluminate waste materials and ores.

The use or disposal of waste materials such as fiberglass, fly ash, silica fume, and the like is a growing problem. Accordingly, processes and methods are needed to increase the usefulness of such waste materials. One means of improving the usefulness of such materials is by grinding the materials to provide pozzolanic materials that more readily react rather than acting simply as fillers. Fly ash below 10 microns in size will react in about five days, whereas submicron size fly ash will react in 4 to 8 hours. Reaction of such materials changes the chemical nature of the materials. FIG. 2 shows the reaction times of fly ash based on the particle size of the fly ash. Fly ash becomes a 95% pozzolan and loses 90% of its porosity at 10 microns and below. Only 40 wt. % of normal fly ash reacts in 28 to 60 days, while 30 wt. % of the normal fly ash takes up to a year to react. The other 30 wt. % of normal fly ash does not react at all and acts as a filler. If the fly ash was ground in an impact mill, 60 wt. % will react in 48 hours, 30 wt. % will react in 5 days, 7 wt. % of the remaining 10% will react in 28 to 60 days. Accordingly, over 90 wt. % of the ground fly ash will react in 5 days. Similar observations can be made for US Silica 325 ground in a ball mill or impact media mill as shown in FIG. 3 and for sand as shown in FIG. 4.

A disadvantage of conventional ball mills and other media mills is that it can take 250 hours or more of grinding and multiple mill changes to obtain particles that have an average −5 micron size. Thus conventional mills cannot effectively produce particles in the −10 to −20 micron range. Ideally, the cost of −20 micron material could be cut drastically if 90 plus percent of the waste material could be ground to −20 microns in a single mill or in a mill that is devoid of media.

In view of the foregoing, embodiments of the disclosure provide a mill for grinding particles to submicron size. The mill has a rectangular prism-shaped housing for two internal barrels. Each internal barrel has a shaft and a plurality of overlapping circular discs attached to the shaft disposed in each barrel for grinding materials to submicron size. Each barrel also has blocked corners providing a cross-sectional shape of half of an octagonal prism disposed toward opposing ends of the housing. The housing also includes comprises curved acceleration ramps disposed between the barrels proximal to the overlapping circular discs on opposing sides of the housing. An inlet is provided for feeding material to be ground by the mill to an overlapped portion of the overlapping circular discs. An outlet is disposed at an end of the mill opposite the inlet for removing ground material from the mill. The overlapping circular discs are rotated in the mill at a shaft speed ranging from about 200 to about 1200 RPM so that particles are ground by the overlapping circular discs to the submicron size.

One embodiment of the disclosure provides a method for grinding particles to a submicron size. The method includes providing a mill having a rectangular prism-shaped housing for two internal barrels, each internal barrel having a shaft and a plurality of overlapping circular discs attached to the shaft disposed in each barrel for grinding materials to submicron size. Each barrel has blocked corners providing a cross-sectional shape of half of an octagonal prism disposed toward opposing ends of the housing. The housing further includes acceleration ramps disposed between the barrels proximal to the overlapping circular discs on opposing sides of the housing. The mill has an inlet for feeding material to be ground by the mill to an overlapped portion of the overlapping circular discs and an outlet disposed at an end of the mill opposite the inlet for removing ground material from the mill. The overlapping circular discs are rotated at a shaft speed ranging from about 200 to about 1200 RPM. Particles to be ground are fed to the inlet of the mill so that particles are ground by the overlapping circular discs to the submicron size.

In another embodiment, each circular disc on one shaft overlaps a circular disc on the other shaft by from about 10 to about 45% of a diameter of the circular disc, or from about 20 to about 40% of a diameter of the circular disc, or from about 30 to about 45% of a diameter of the circular disc.

In other embodiments, the curved acceleration ramps have curved sidewalls such that the curved sidewalls have a circumference that is approximately the same as the circumference of the circular discs.

In some embodiments, the overlapping circular discs are circular discs circular grinding discs devoid of flow through features for particle transport through the mill. In other embodiments the overlapping circular discs are flow through discs having have a first set of spaced-apart rectangular bars defining a first plane wherein the first set of spaced-apart rectangular bars is directly attached cross-wise to a second set of spaced-apart rectangular bars, wherein the second set of spaced-apart rectangular bars defines a second plane offset from and directly on top of the first plane, and wherein openings through the circular discs are provided orthogonal to the first and second planes thereof. In other embodiments, each rectangular bar of at least one of the first or second set of spaced-apart rectangular bars has a castellated configuration. In some embodiments, the castellated bars are axially aligned to an adjacent row of castellated bars in the first plane, in the second plane, or in both the first and second planes. In still other embodiments, the castellated bars are offset from an adjacent row of castellated bars in the first plane, in the second plane, or in both the first and second planes.

In other embodiments, a cooling system is provided for cooling walls of the housing adjacent to the blocked corners of the housing and adjacent to the acceleration ramps.

In some embodiments, the mill is selected from a vertical mill and a horizontal mill. In other embodiments, the mill is devoid of grinding media.

In other embodiments, overlapping circular discs are rotated in the mill at a shaft speed ranging from about 300 to about 1000 RPM or from about 400 to about 800 RPM, or from about 300 to about 600 RPM.

An advantage of the embodiments of the disclosure is that the mill may be used to grind particles to submicron size that are otherwise difficult to grind such as malleable materials. The high speed kinetics of the slicing and cutting blades of discs made of hardened stainless steel will also shatter and break friable structures and crystals. Materials that may be effectively ground to submicron size include, but are not limited to fly ash, sawdust, switchgrass, cellulosics in general, fiberglass, pigments, sand, and the like. Grinding may be done in the presence or absence of media, and may be ground more efficiently with higher throughput that with conventional media grinding mills. Unlike conventional mills, the mill and disc of the disclosed embodiments may be used to grind relatively long strand materials to provide pozzolanic materials that react rather than serve merely as filler materials in compositions such as concrete, mortar, paint, and the like. Also, an increased overlap area of the discs in the central portion of the mill may provide equal shear value without the use of media.

DETAILED DESCRIPTION OF EXEMPLARY EMBODIMENTS

As set forth above, embodiments of the disclosure provide submicron grinding mills and discs therefor that are suitable for providing submicron particles from materials that are difficult to grind using other conventional grinding machines and discs. For example, the grinding mills described herein may be suitable for grinding fibrous materials such as fiberglass and switchgrass to submicron sizes so that the materials can react rather than act only as filler materials. Accordingly, materials ground in the submicron range, i.e., −10 to −20 microns may be small enough to react on their own without the need for hydrolysis or digestion techniques.

Figures 1A, 1B:
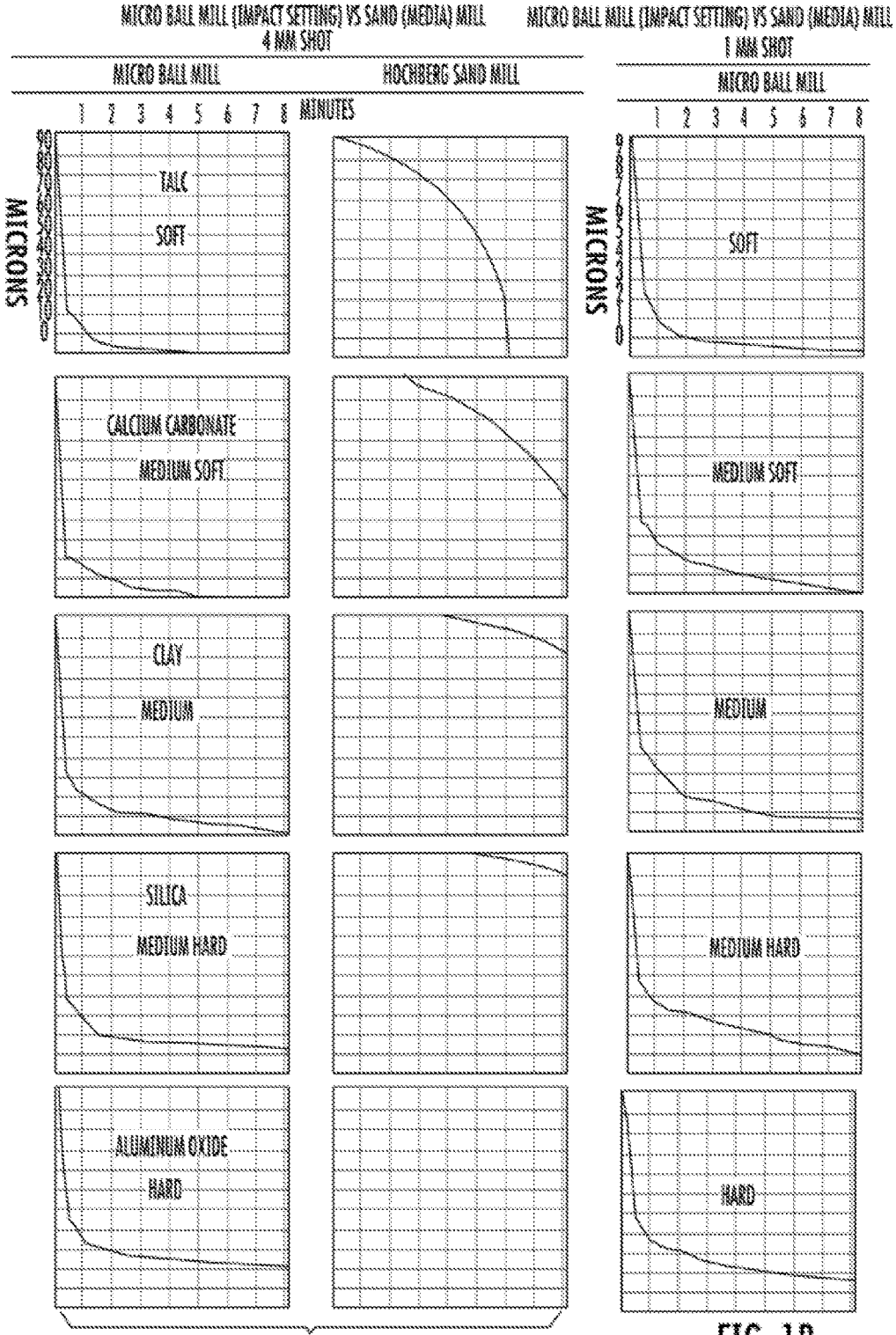
FIGS. 1A and 1B are comparisons of milling times with different grinding choices of 90% shear to 10% stress on a variety of materials compared to a sand mill for the same materials (shows where shear gives way to stress at about 7 microns).
Figure 2:
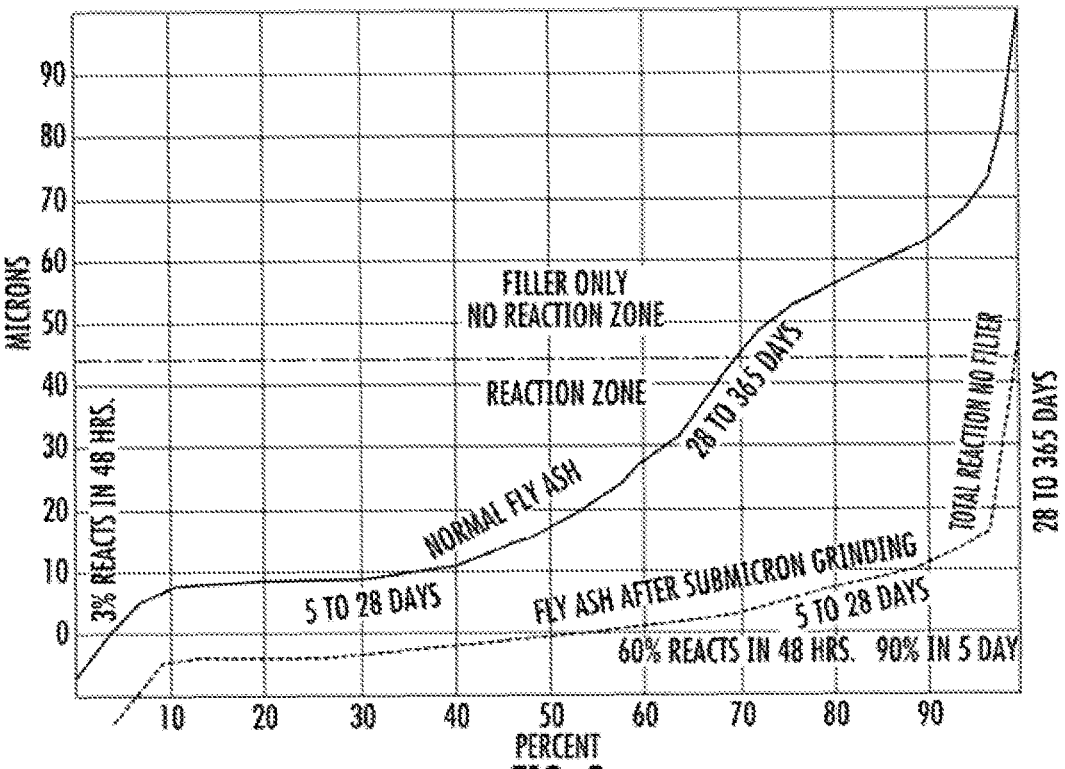
FIG. 2 is a graphical illustration of reaction times of fly ash based on the particle size of the fly ash.
Figure 3:
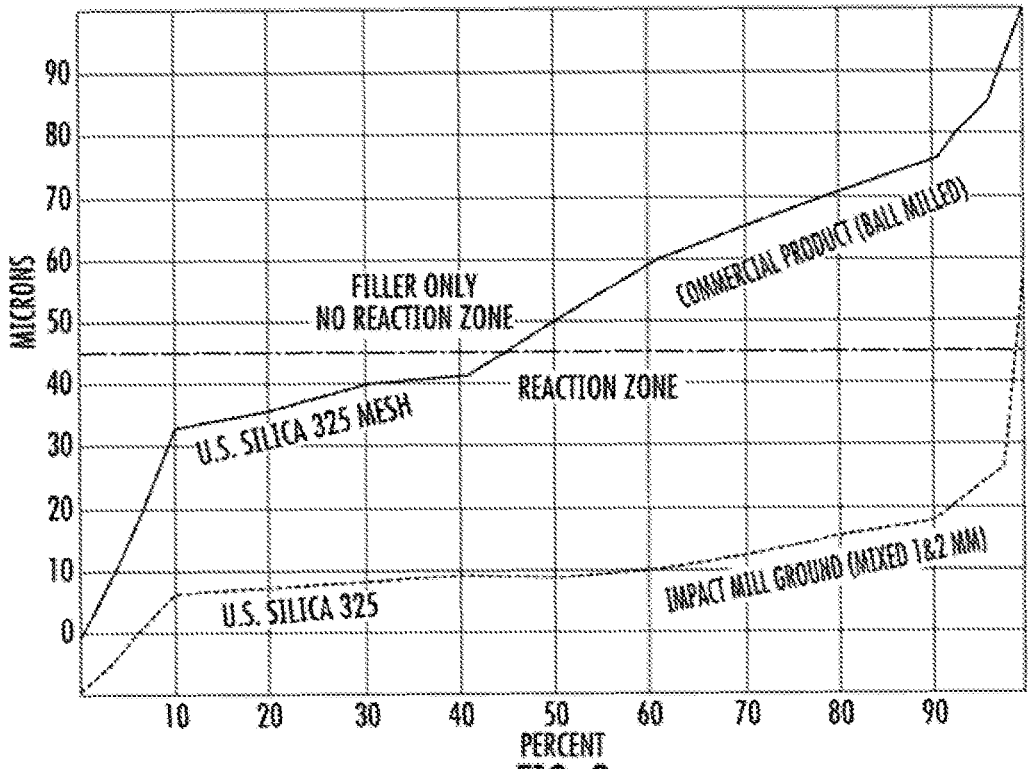
FIG. 3 is a graphical illustration of reaction times of silica based on the particle size of silica.
Figure 4:
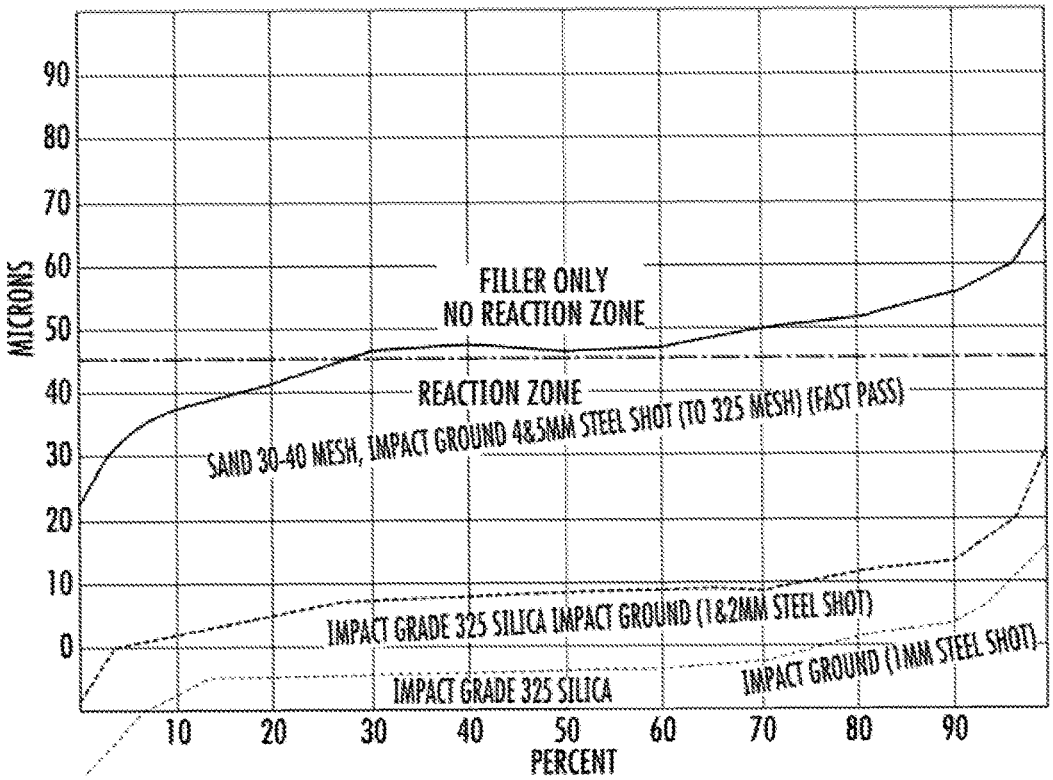
FIG. 4 is a graphical illustration of reaction times of sand based on the particle size of the sand.
Figure 5:
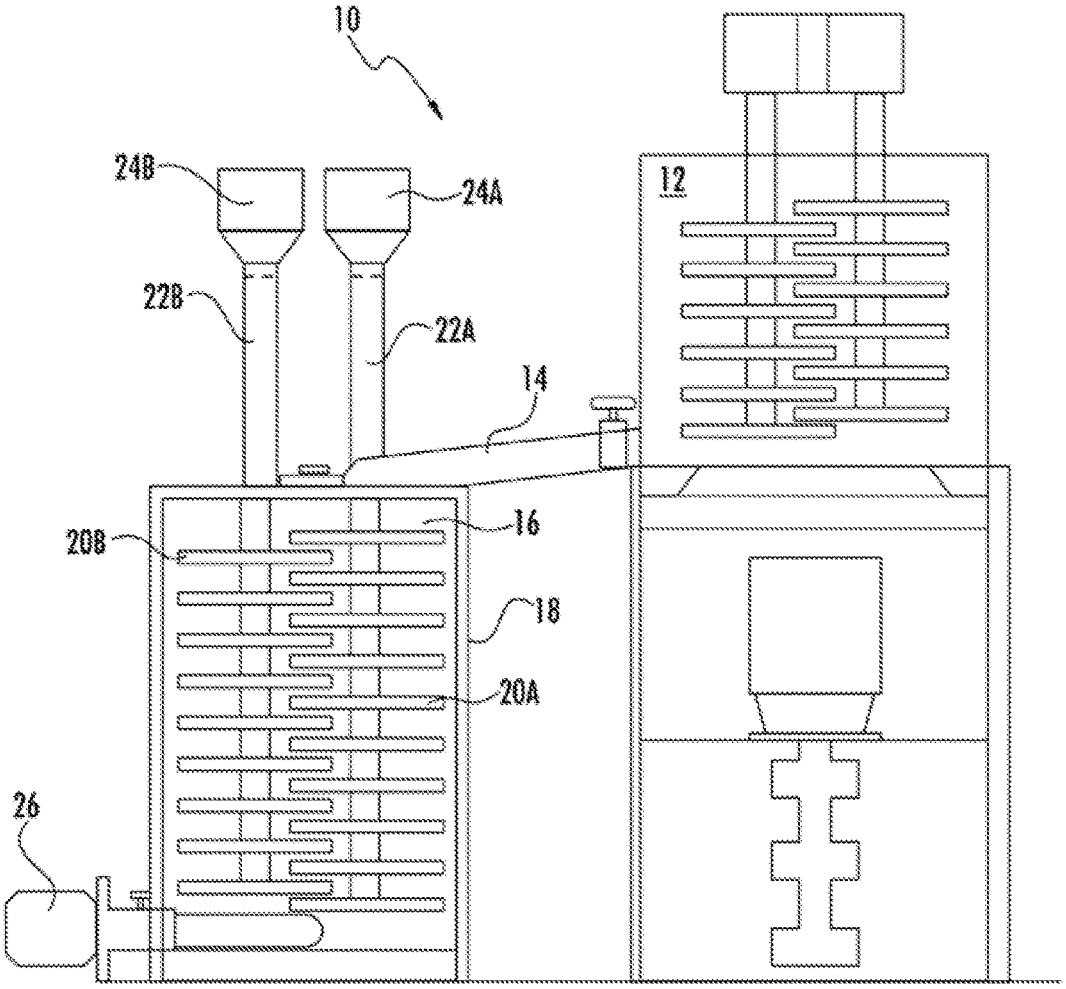
FIG. 5 is a graphical illustration of a sand and fiberglass dispersing and grinding process using a submicron grinding mill according to an embodiment of the disclosure.

In order to illustrate the features and advantages of the disclosed embodiments, reference is made to FIG. 5 which is a schematic illustration of a sand grinding process 10. The process 10, shown in FIG. 5, includes a pre-grinding device 12 that provides a substantially homogeneous feed material as small as 325 mesh silicon through feed chute 14 to chamber or barrel 16 of a submicron grinding mill 18. The grinding mill 18 includes specially designed grinding discs 20A and 20B that are attached to shafts 22A and 22B and motors 24A and 24B. The chamber 16 includes barrels for each set of grinding discs as described in more detail below. The silica liquid material (same size as commercial 325 mesh powder) flows through the grinder 18 by gravity and out a discharge chute 26 disposed on an opposite end of the grinder 18 from the feed chute 14. Silica when ground to pozzolan sizes becomes a very valuable material and becomes a light weight concrete ingredient.

Figure 6:
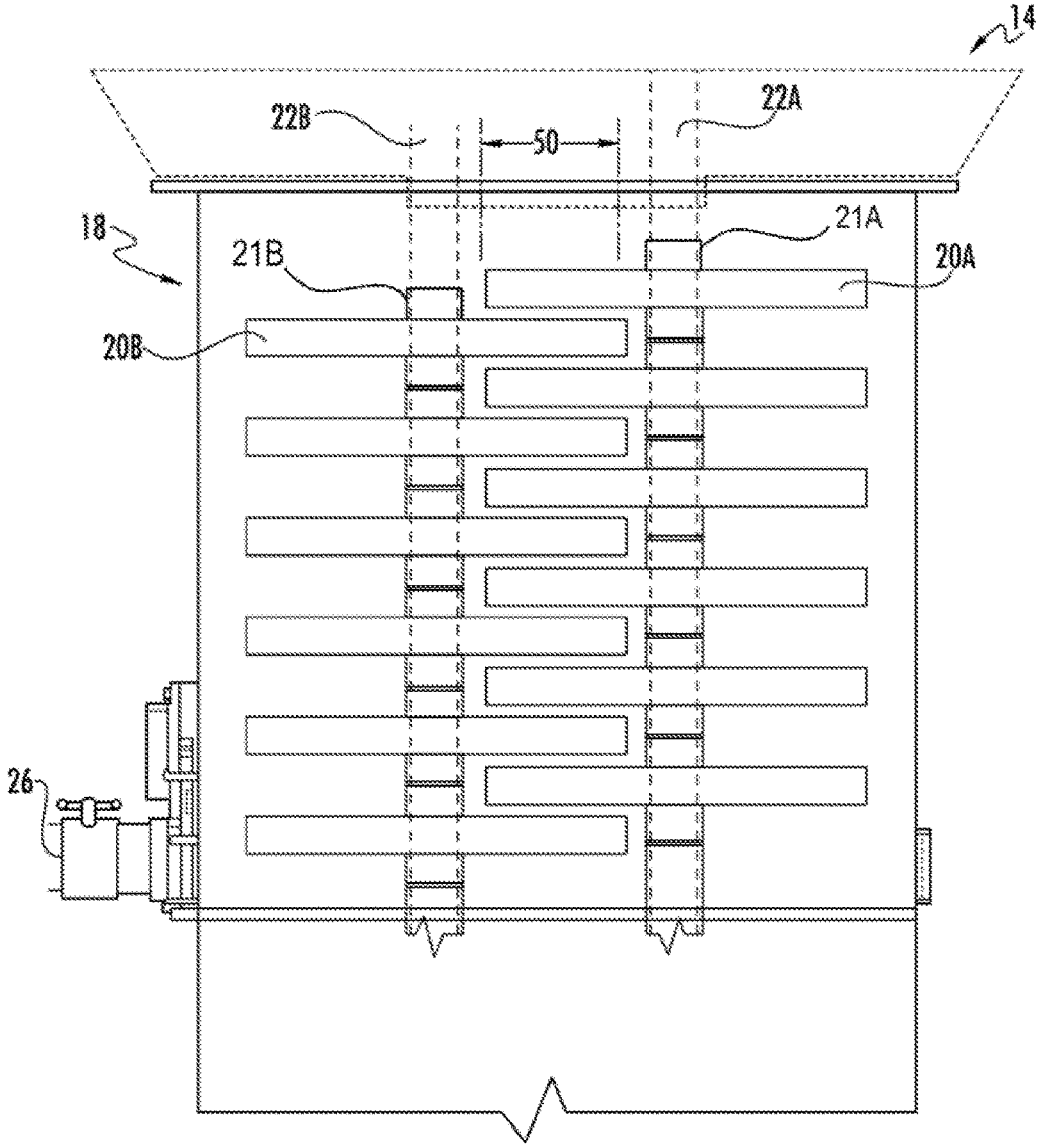
FIG. 6 is a cross-sectional schematic illustration, not to scale, of overlapping discs in a horizontal arrangement of a vertical submicron grinding mill according to an embodiment of the disclosure.

As shown in FIG. 6, the discs 20A and 20B are designed to be stacked on and affixed to shafts 22A and 22B preferably leaving none of the shafts 22A and 22B exposed throughout the array of discs 20A and 20B. Accordingly, each of the discs 20A and 20B is affixed to a hub 21A or 21B that essentially covers a portion of the shaft 22A or 22B adjacent to each disc. Having no exposed shafts 22A and 22B permits easy cleanup and eliminates contamination in subsequent, but different material batches. As the shafts 22A and 22B and discs 20A and 20B rotate, the discs 20A and 20B imparts a shearing and chopping action to the raw material to be ground. As the raw material flows by gravity from the inlet of the mill to the exit, it passes through the open areas 36 of the discs 20A and 20B as described below. A suction diaphragm pump may also be used to aid in flowing the material through the mill from the inlet 14 to the exit 26.

Another feature of the disclosed embodiments is the degree of overlap of the discs 20. Unlike a conventional media mill, the discs 20A and 20B, have an overlap 50 that is substantial. Compared to the conventional media mill, the overlap 50 is 300% greater. Accordingly, the overlap 50 may range from 10 to about 45% of a diameter of the circular discs 20A and 20B, or from about 20 to about 40% of a diameter of the circular discs 20A and 20B, or from about 30 to about 45% of a diameter of the circular discs 20A and 20B. The material to be ground is fed into the overlapping zone of the overlapped discs thereby reducing chamber wear significantly. Accordingly, chamber wear may be reduced by 75% or more compared to a conventional grinding or media mill.

Figure 7:
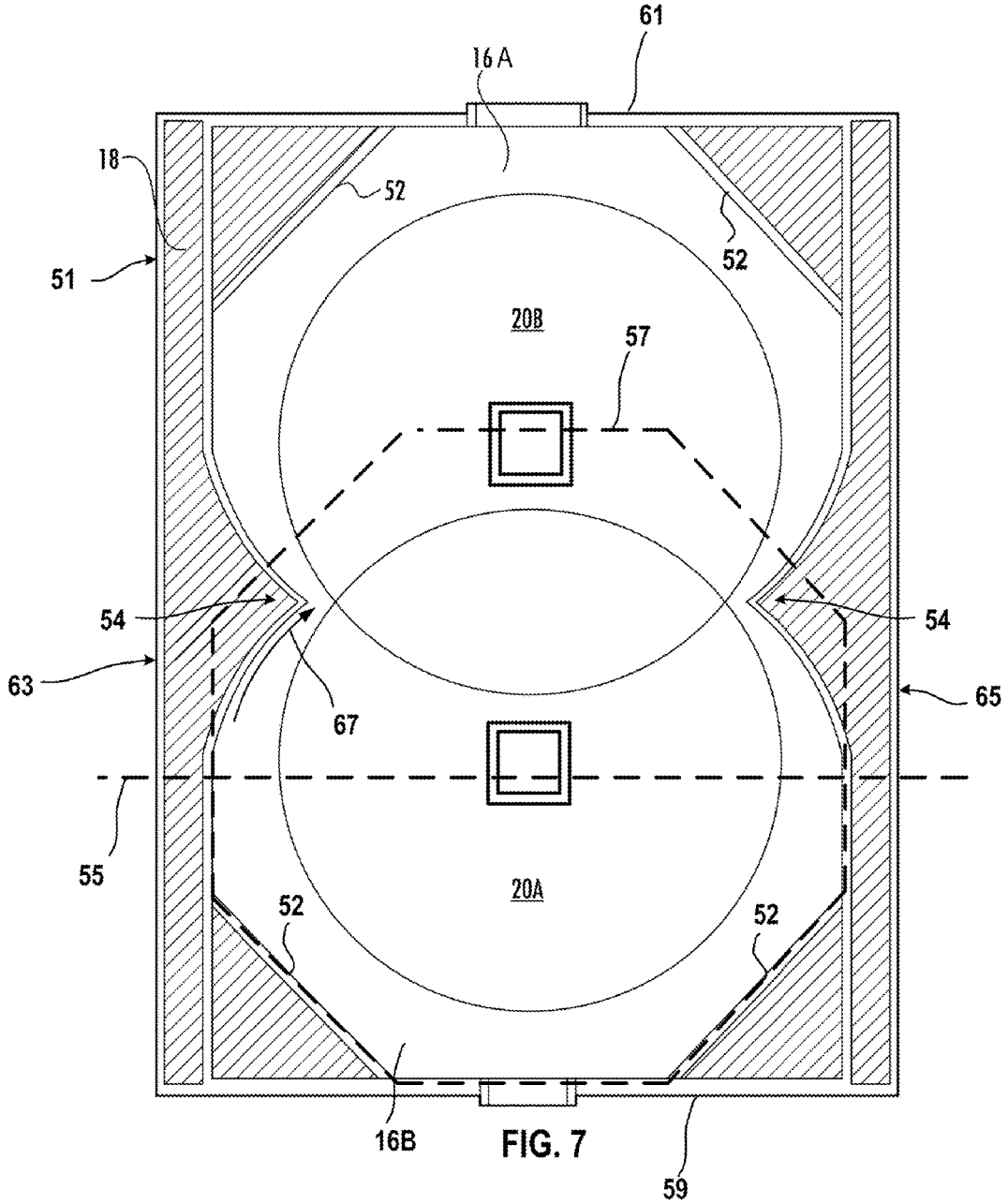
FIG. 7 is a top plan view, not to scale of the vertical barrels of the mill of FIG. 6

A top plan view of the barrel 16 of the mill 18 is illustrated in FIG. 7. The mill 18 includes a rectangular prism-shaped housing 51 for two internal barrels 16A and 16B, each internal barrel 16 has a shaft 22 and a plurality of overlapping circular discs 20 attached to the shaft 22 disposed in each barrel 16 for grinding materials to submicron size. Each barrel has blocked corners 52 providing a cross-sectional shape of half of an octagonal prism (represented by dotted lines 55 and 57 in FIG. 7) disposed toward opposing ends 59 and 61 of the housing 51. Material to be ground between the two octagonal prism halves and in the overlapped area of the discs 20A and 20B experiences opposing vector grinding. Material to be ground that is disposed toward the opposing ends of 59 and 61 of the housing experience spin rotation and circulation of the material in the mill 18.

The housing 51 further includes curved acceleration ramps 54 disposed between the barrels 16A and 16B proximal to the overlapping circular discs 20A and 20B on opposing sides 63 and 65 of the housing 51. The acceleration ramps 54 are effective to compress and speed the material to be ground in the direction of arrow 67 toward the overlapped area of the discs 20A and 20B. The acceleration ramps 54 have curved sidewalls such that the curved sidewalls have a circumference that is approximately the same as a circumference of the circular discs 20A and 20B.

Each of the blocked corners 52 and curved acceleration ramps 54 may be provided with cooling coils to cool the barrel 16 to reduce wear. Like the discs 20A and 20B, the barrel 16 may made from hardened stainless steel 440C.

Figure 8:
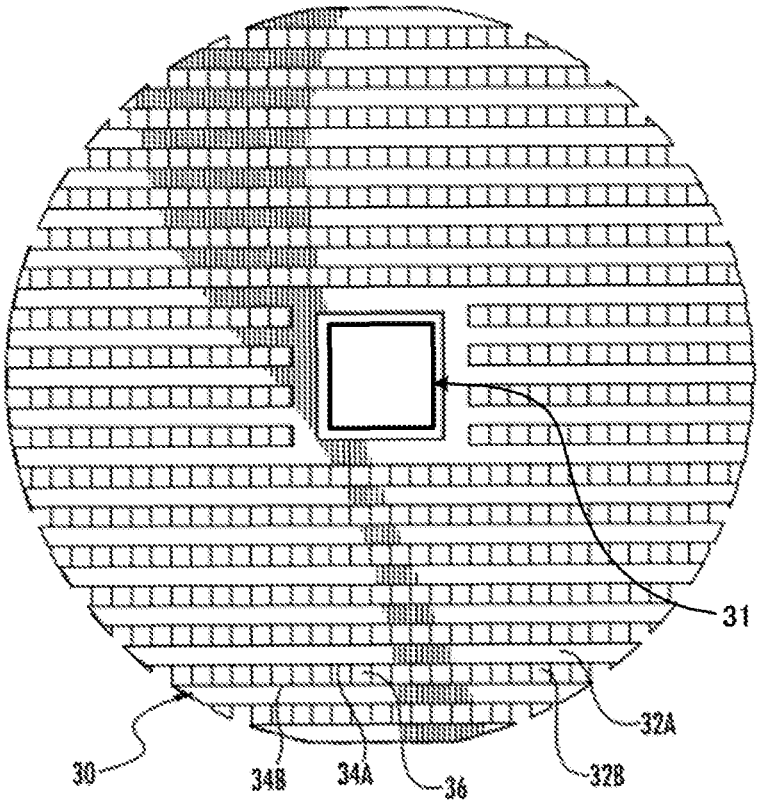
FIG. 8 is an illustration of a grinding disc according to one embodiment of the disclosure.
Figure 9:
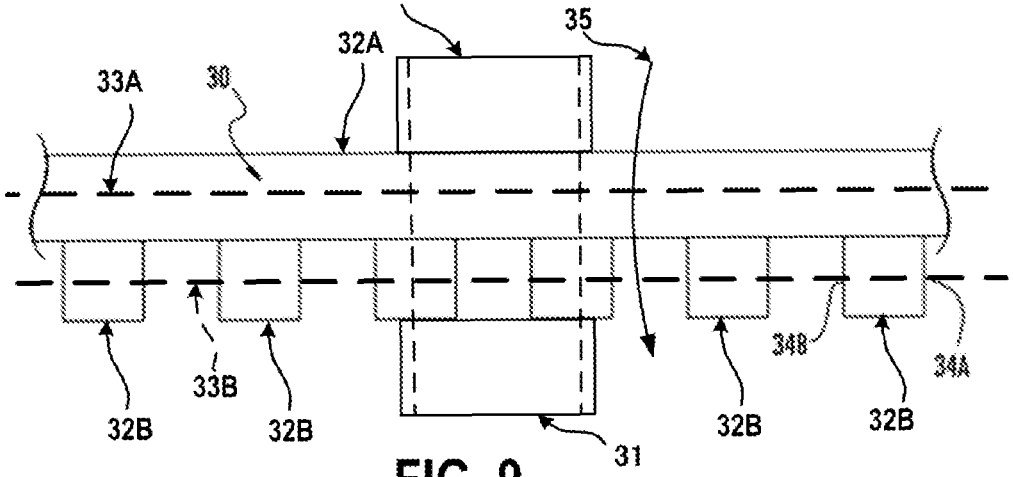
FIG. 9 is a cross-sectional view, not to scale of a portion of the disc of FIG. 8

FIGS. 8 and 9 illustrate a flow-through grinding disc 30, according to one embodiment of the disclosure, that may be used in the grinder 18 for grinding fiberglass. The disc 30 has a flow-through design provided by overlapping rectangular bars 32A and 32B. As shown in FIGS. 8 and 9, the discs 30 have a first set of spaced-apart rectangular bars defining a first plane defined by centerline 33A. The first set of spaced-apart rectangular bars 32A is directly attached cross-wise to a second set of spaced-apart rectangular bars 32B, wherein the second set of spaced-apart rectangular bars 32B defines a second plane defined by centerline 33B offset from and directly on top of the first plane. Openings 36 are provided through the disc 30 orthogonal to the first and second planes thereof so that particles flow through the disc in the direction of arrow 35. Each bar 32A and 32B has at least two opposing walls 34A and 34B orthogonal to the first and second planes. As shown in FIG. 8, material to be ground can flow through the open areas 36 between the rectangular bars 32A and 32B. As the fiberglass or fibrous material flows through the discs 30, the spinning discs 30 chop or otherwise slice and shatter the fibrous material to provide material of submicron size.

Figure 10A:
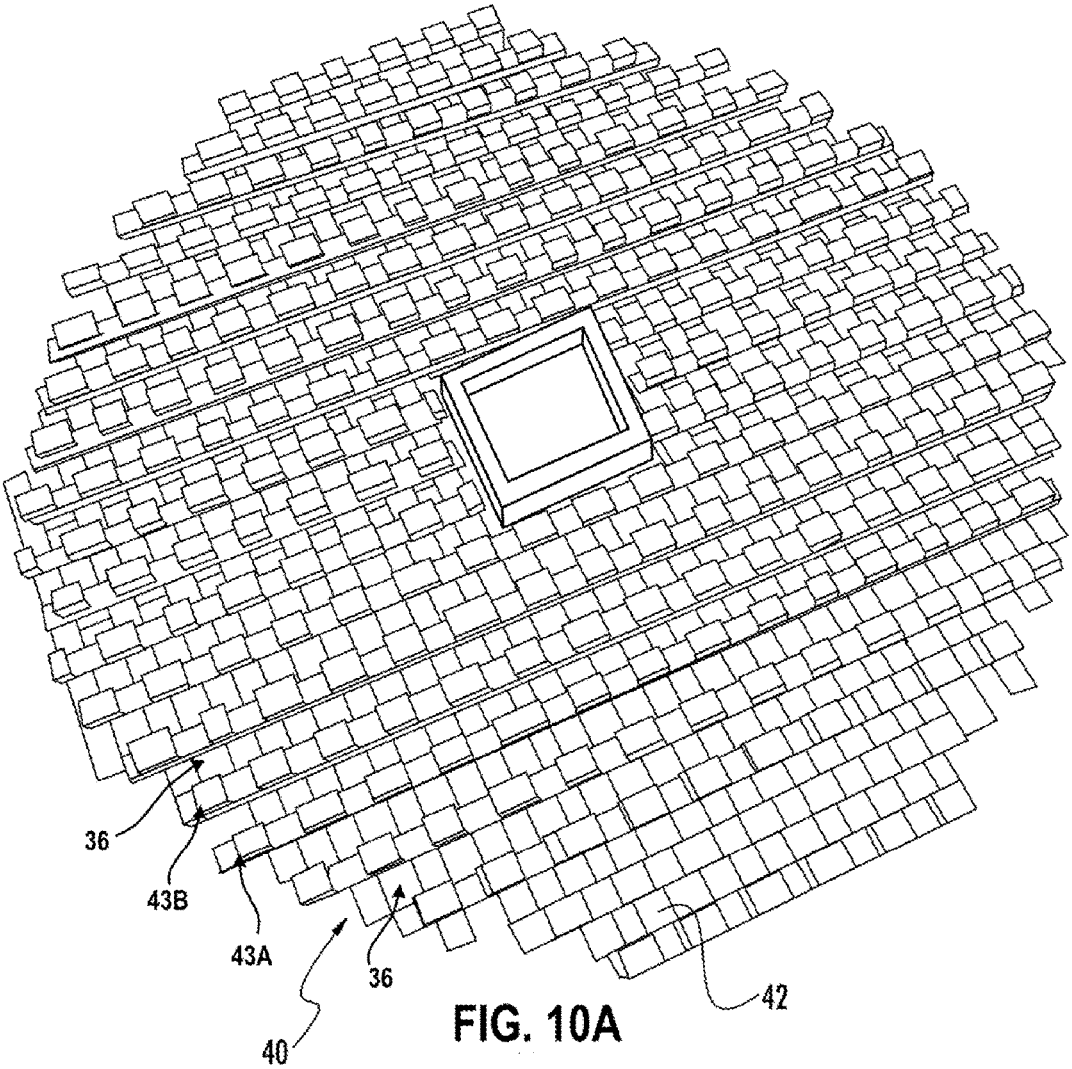
FIG. 10A is a plan view of a grinding disc according to a second embodiment of the disclosure.
Figure 10B:
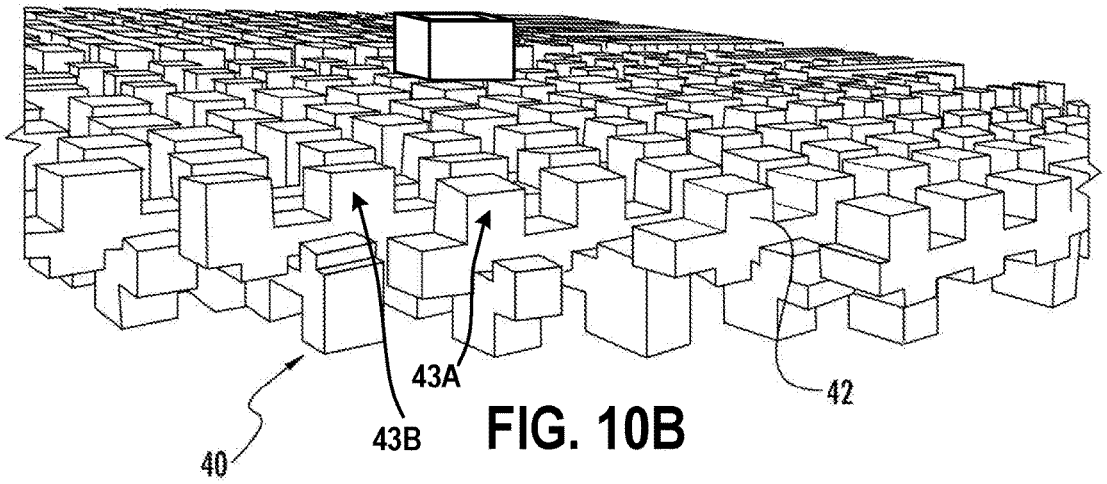
FIG. 10B is an elevational view of the grinding disc of FIG. 10A.
Figure 10C:
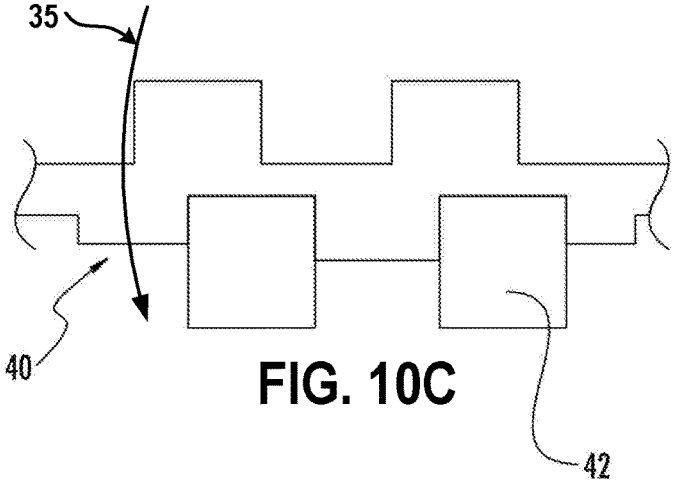
FIG. 10C is a partial cross-sectional view of a portion of the grinding disc of FIG. 10A.
Figure 11A:
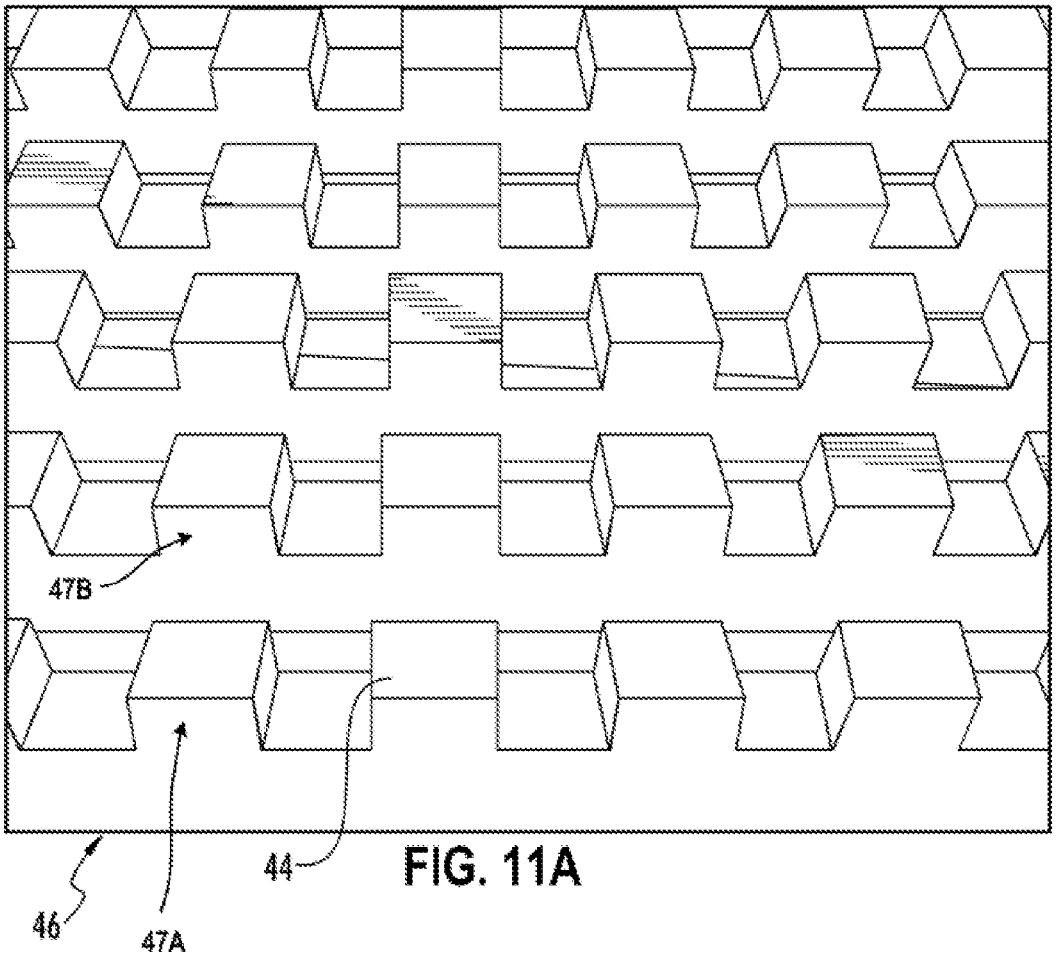
FIG. 11A is a perspective view of a portion of a grinding disc according to a third embodiment of the disclosure.
Figure 11B:
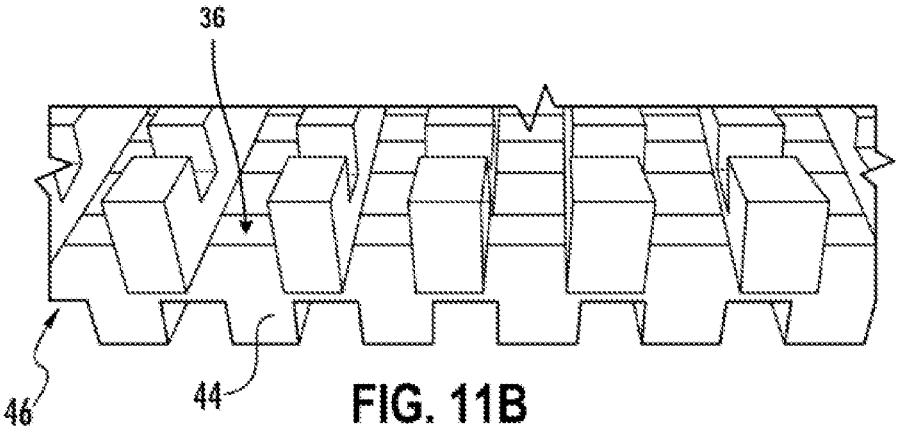
FIG. 11B is a side view of a portion of the grinding disc of FIG. 11A.

FIGS. 10A-10C and FIGS. 11A-11B illustrate alternative disc designs that may be used for grinding other types of materials or may be used in combination with the grinding disc 30 in a single grinding mill. In FIGS. 10A-10C, the blades 42 of disc 40 are cubical blades 42 having at least four walls that are orthogonal to a plane defined by the disc 40. In FIG. 10A, the cubical blades 42 are in a row 43A that is offset from an adjacent cubical blade row 43B. In FIGS. 11A and 11B, the cubical blades 44 of the disc 46 are in a row 47A that is aligned with an adjacent cubical blade row 47B. The cubical blades 42 or 44 are scalable and may have a size ranging from about 0.25 inches square to about 1.0 inches square or more, such as from about 0.38 inches square to about 0.5 inches square. It will be appreciated that the bars 32 and blades 42 and 44 may be scalable with the diameter of the discs 30, 40 and 46.

The foregoing discs 30, 40 and 46 are flow through discs and are typically cast from stainless steel and may be investment cast using 28 wt. % chrome. Chrome adds substantial hardness to the discs 30, 40, 46. Hardened stainless steel 440C may be used as the disc material to both provide a contaminant free operating environment and to greatly enhance longevity and durability of the discs. Typically, 19 inch discs are used in 33 inch barrels and 24 inch discs are used in 44½ inch barrels. However, these discs may be cast in variety of sizes from 12 inches in diameter to more than 48 inches in diameter. The discs are primarily suitable for use in double-barrel mills. But other applications, including but not limited to multi-barrel mills and horizontal mills, will be apparent to those familiar with media mills in general. The discs play an important part in the efficiency of the overall process of these mills and are an important part of the total process. Multiple types of discs 30, 40 or 46 may be used in a single grinding mill in stacked arrangements to provide grinding and pumping of materials in the mill.

Figure 12:
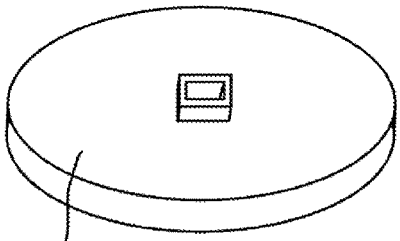
FIGS. 12-15 are perspective views, not to scale, of grinding discs that may be used with the mill of the disclosed embodiments.
Figure 13:
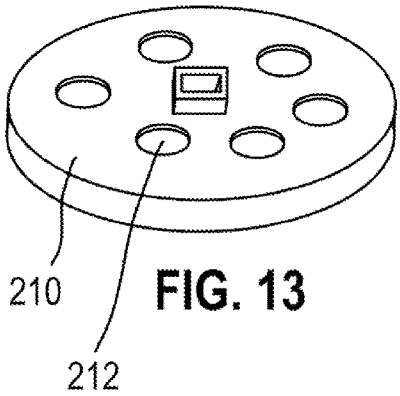
Figure 14:
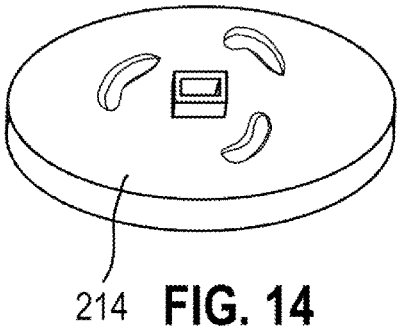
Figure 15:
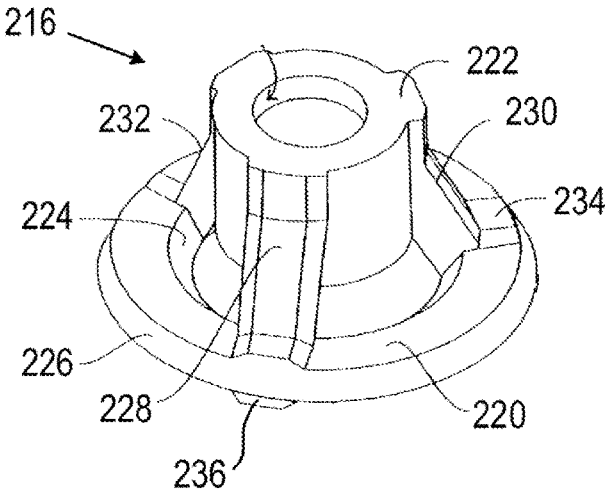

Other discs that may be used in combination with or in place of discs 30, 40 and 46 in mill 18 include a solid disc 200 (FIG. 12), disc 210 (FIG. 13) having round holes 212 therein, a slightly ported disc 214 (FIG. 14), and a disc 216 (FIG. 15) having a planar disc blade 220 spaced a distance apart and downward from an end 222 of the hub. The planar disc blade 220 also includes an inner chamfer 224 and an outer chamfer 226. The disc 216 includes a plurality of equidistant vanes 228, 230, and 231 extending angularly downwardly and radially from the end 222 of the hub toward the planar disc blade 220. A plurality of raised pods 234 and 236 may be spaced about the planar disc blade 220 on opposing sides thereof. Each vane includes respective raised pods 234 and 236.

The foregoing discs of FIGS. 12 to 15 are typically cast from stainless steel and may be investment cast utilizing 28% chrome. The chrome adds substantial hardness to the discs. Hardened stainless steel 440C may be used to provide a contaminant free operating environment and to greatly enhance longevity and durability of the disc.

In alternative embodiments, media, such metal and zirconium oxide be used in the mill 18 with any one or more of the discs 30, 40, 46, 200, 210, 214 or 216 described above. However, a feature of the invention is that the mill 18 is highly effective and efficient for preparing submicron particles, even without media.

In another embodiment, the grinding mill may have the shaft drives located at the discharge end of the mill and have a substantially open top for feed of material into the mill adjacent the overlapping areas of the discs. The mill may also be considered a horizontal/vertical mill or HV mill.

Figure 16A:
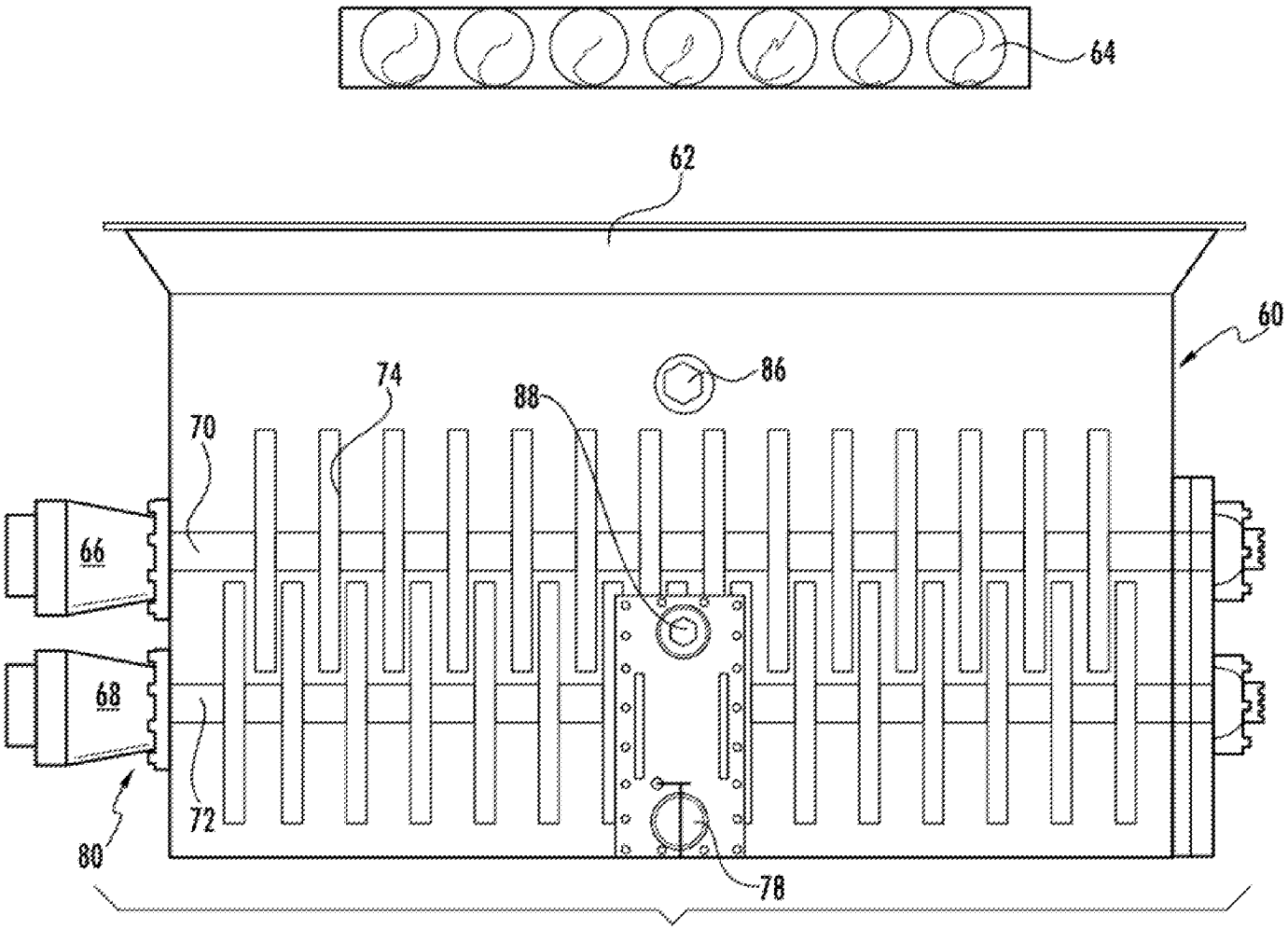
FIGS. 16A-16C are cross-sectional schematic illustrations of a horizontal mill using the grinding discs in a vertical arrangement according to an embodiment of the disclosure.
Figure 16B:
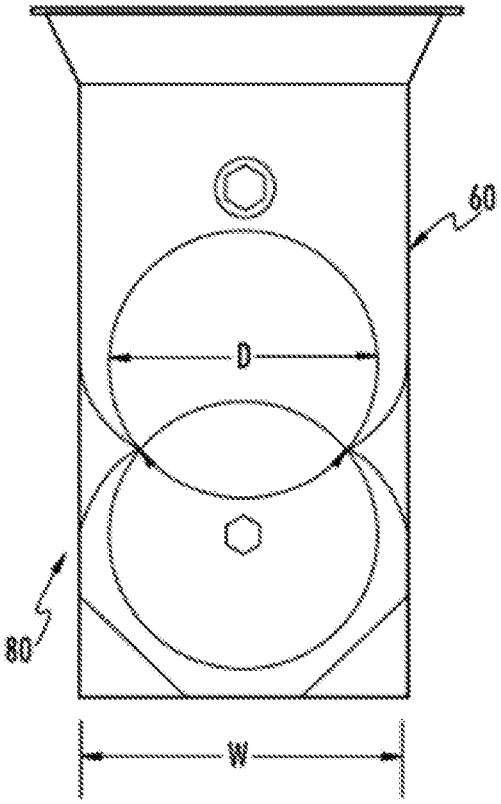
Figure 16C:
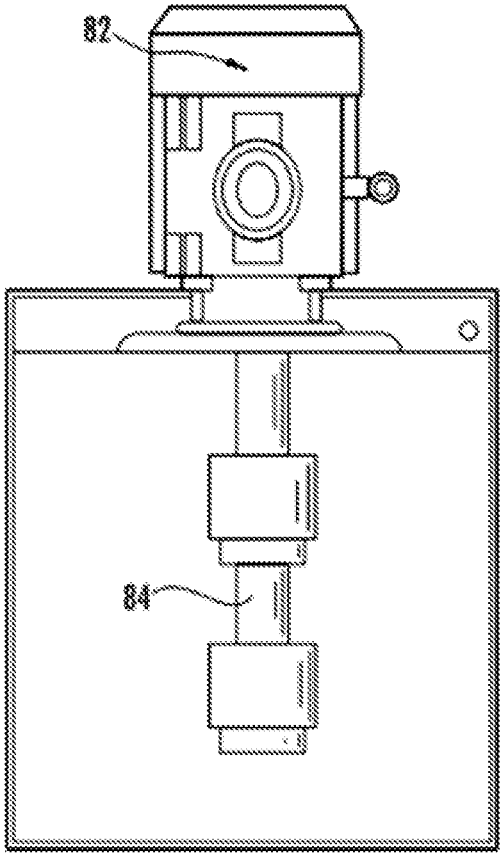

In yet another embodiment illustrated in FIGS. 16A-16C, the mill 60 may be a horizontal mill have an open top 62 for feeding material into the mill 60 by means of a multiple screw conveyor 64. Drives 66 and 68 and shafts 70 and 72 each containing multiple disc 74 are disposed perpendicular to the open top 62 for cutting and grinding material fed into the mill by the conveyor 64 orthogonal to rotating axes of shafts 70 and 72. A material discharge port 78 is located adjacent a lower portion of the mill 60 opposite the open top 62. For example, the mill 60 may grind up to about 30 truckloads of sawdust per day.

An end view opposite the drive side 80 of the mill 60 is shown in FIG. 16B. The diameter D of the discs 74 is at least about 75 to 85% of the total width W of the mill 60. Accordingly, as the material is fed into the mill 60, it comes in intimate contact with the rotating discs 74 which act to recirculate and grind the material in the mill 60. A single motor 82 containing a drive shaft 84 is attached to the drive side 80 of the mill 60 and may be connected to both drives 66 and 68 to rotate the discs 74 in the mill 60. In the alternative, each shaft 70 and 72 may be driven by a separate motor at different rotational speeds. The mill 60 is adaptable to feeding material in through the top 62 and out of the discharge port 78, in through the port 78 and out through an upper discharge port 86 or in the top 62 or port 78 and out through an intermediate discharge port 88.

The mill 60 is particularly designed for chopping and slicing fibrous materials such as whole plants of switchgrass and the like to provide ethanol fuel materials. The discs 74 are specifically designed for such materials and may typically include the disc of FIGS. 10A-10C having cubical cutting blades for slicing and cutting malleable materials as well as shattering and grinding friable materials.

Figure 17:
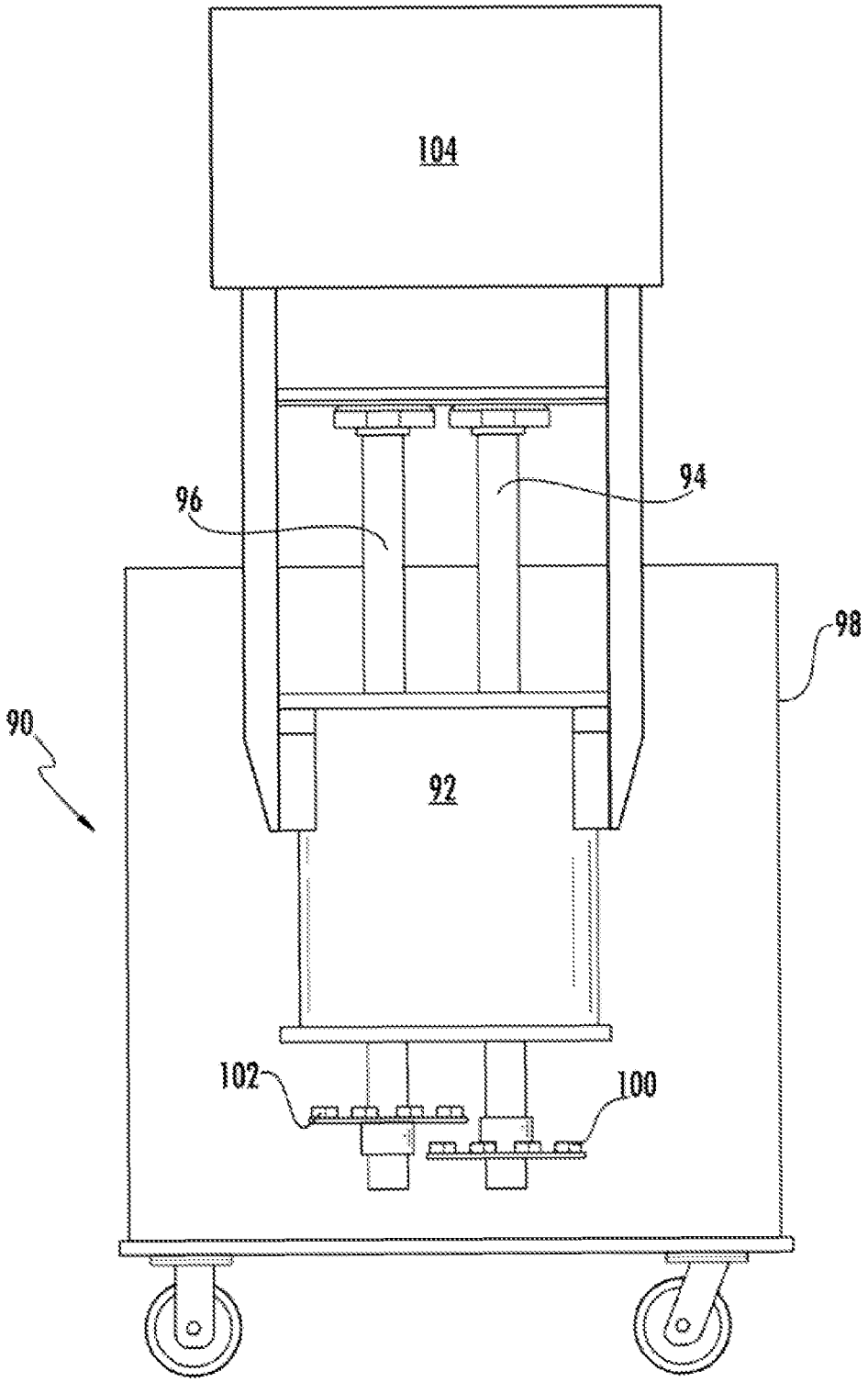
FIG. 17 is an elevational view of a non-media immersion mill using discs wherein a flow through shroud is used as a cover according to embodiments of the disclosure.

A further embodiment of the disclosure is illustrated in FIG. 17. FIG. 17 illustrates schematically, an immersion mill 90 that may contain two, four or more of the discs 30, 40, and 46 described above. The immersion mill 90 includes an immersion barrel 92 that includes the shafts and discs generally as described above with respect to FIG. 10. However, in the immersion mill, the shafts 94 and 96 may extend through the barrel 92 and into a tank 98 or other process equipment for making a dispersion with ground material from the mill 92. Pumping or mixing blades may be attached adjacent terminal ends of the shafts 94 and 96 to provide mixing of the ground material with other materials in the tank 98. A drive unit 104 containing one or more drive motors may be attached to the shafts 94 and 96 to rotate the discs in the immersion barrel 92. A lift mechanism, not shown, may be used to move the immersion mill barrel 92 into and out of the tank 98. The immersion mill 90 may also be used to pre-grind the material for feed to a chamber mill as described above.

The mills according to the disclosure may provide a combination of grinding techniques in a single mill. Accordingly, the disclosed mills include blocked corners that provide circulation of material to be ground similar to a blocked corner mill having a single round disk in the center thereof. The disclosed mills may also provide opposing vector grinding similar to a mill having staggered, overlapping discs rotating in the same direction in a gated center mill chamber. Additionally the disclosed mills may provide grinding according to the Hochberg Mill Principle. All of the foregoing grinding techniques may be equally present in a single mill according to the disclosure or the mill may be adjusted to favor one principle over the other principles depending on the material to be ground by modifying the mill chamber and discs within the mill chamber.

The discs 40 or 46 having cubical cutting blades 42 and 44 not only serve the normal disc functions of grinding and chopping but also serve to effectively increase the surface area of the chamber for grinding and milling. Accordingly, the working surface are of the chamber is increased by about 3.5 times that of a conventional grinding mill.

The rotational speed of the shafts and discs in the mills described herein may range from about 200 to about 1200 RPM, such as from about 300 to about 1000 RPM or from about 400 to about 800 RPM, or from about 300 to about 600 RPM, while conventional mills may have rotational speeds ranging from 900 to 1400 RPM or higher. Accordingly, the mills according to the disclosure may run cooler and have less wear than conventional grinding mills. Because the mills and discs described herein provide more efficient grinding, the throughput of material in the mills may be 10 to 20 times greater than the throughput of a conventional mill. For example, a conventional ball mill may produce −5 micron material in about 250 hours, whereas a mill according to the disclosure may provide −10 to −20 micron material in about 10 to about 30 minutes.

The terms defined in this application are to be interpreted without regard to meanings attributed to these terms in prior related applications and without restriction of the meanings attributed to these terms in future related applications.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claimed invention.

What is claimed is:

1. A mill for grinding particles to submicron size comprising:

a rectangular prism-shaped housing for two internal barrels, each internal barrel having a shaft and a plurality of overlapping circular discs attached to the shaft disposed in each barrel for grinding materials to submicron size, wherein each barrel having blocked corners providing a cross-sectional shape of half of an octagonal prism disposed toward opposing ends of the housing, wherein the housing further comprises curved acceleration ramps disposed between the barrels proximal to the overlapping circular discs on opposing sides of the housing, an inlet for feeding material to be ground by the mill to an overlapped portion of the overlapping circular discs;

and an outlet disposed at an end of the mill opposite the inlet for removing ground material from the mill, wherein the overlapping circular discs are rotated in the mill at a shaft speed ranging from 200 to about 1200 RPM so that particles are ground by the overlapping circular discs to the submicron size.

2. The mill of claim 1, wherein each circular disc on one shaft overlaps a circular disc on the other shaft by from 30 to about 45% of a diameter of the circular disc.

3. The mill of claim 1, further comprising a cooling system for cooling walls of the housing adjacent to the blocked corners of the housing and adjacent to the acceleration ramps.

4. The mills of claim 1, wherein the curved acceleration ramps have curved sidewalls such that the curved sidewalls have a circumference that is approximately the same as a circumference of the circular discs.

5. The mill of claim 1, wherein each of the overlapping circular discs comprise flow through discs having have a first set of spaced-apart rectangular bars defining a first plane wherein the first set of spaced-apart rectangular bars is directly attached cross-wise to a second set of spaced-apart rectangular bars, wherein the second set of spaced-apart rectangular bars defines a second plane offset from and directly on top of the first plane, and wherein openings through the circular disc are provided orthogonal to the first and second planes thereof.

6. The mill of claim 5, wherein each rectangular bar of at least one of the first or second set of spaced-apart rectangular bars has a castellated configuration.

7. The mill of claim 6, wherein the castellated bars are axially aligned to an adjacent row of castellated bars in the first plane, in the second plane, or in both the first and second planes.

8. The mill of claim 6, wherein the castellated bars are offset from an adjacent row of castellated bars in the first plane, in the second plane, or in both the first and second planes.

9. The mill of claim 1, wherein the overlapping disc are circular grinding discs devoid of flow through features for particle transport through the mill.

10. The mill of claim 1, wherein the mill is selected from the group consisting of a vertical mill and a horizontal mill.

11. A method for grinding particles to submicron size comprising the steps of:

feeding a material to be ground to the mill of claim 1 and operating the mill at the shaft speed of about 300 to about 600 rpm so that the discs grind the particles to submicron size.

12. The method of claim 11, wherein the mill is devoid of grinding media.

13. A method for grinding particles to a submicron size comprising:

providing a mill having a rectangular prism-shaped housing for two internal barrels, each internal barrel having a shaft and a plurality of overlapping circular discs attached to the shaft disposed in each barrel for grinding materials to submicron size, wherein each barrel having blocked corners providing a cross-sectional shape of half of an octagonal prism disposed toward opposing ends of the housing, wherein the housing further comprises acceleration ramps disposed between the barrels proximal to the overlapping circular discs on opposing sides of the housing, the mill having an inlet for feeding material to be ground by the mill to an overlapped portion of the overlapping circular discs and an outlet disposed at an end of the mill opposite the inlet for removing ground material from the mill, rotating the overlapping circular discs at a shaft speed ranging from 200 to about 1200 RPM; and feeding particles to be ground to the inlet of the mill so that particles are ground by the overlapping circular discs to the submicron size.

14. The method of claim 13, wherein each circular disc on one shaft overlaps a circular disc on the other shaft by from 30 to about 45% of a diameter of the circular disc.

15. The method of claim 13, wherein the curved acceleration ramps have curved sidewalls such that the curved sidewalls have a circumference that is approximately the same as a circumference of the circular discs.

16. The method of claim 13, wherein each of the overlapping circular discs comprise flow through discs having have a first set of spaced-apart rectangular bars defining a first plane wherein the first set of spaced-apart rectangular bars is directly attached cross-wise to a second set of spaced-apart rectangular bars, wherein the second set of spaced-apart rectangular bars defines a second plane offset from and directly on top of the first plane, and wherein openings through the circular discs are provided orthogonal to the first and second planes thereof.

17. The method of claim 13, wherein the mill is selected from the group consisting of a vertical mill and a horizontal mill.

18. The method of claim 13, wherein the overlapping disc are circular grinding discs devoid of flow through features for particle transport through the mill.

19. The method of claim 13, wherein the discs are rotated at a shaft speed ranging from 300 to about 600 RPM.

* * * * *